United States Patent [19]

Putz

[11] Patent Number: 4,858,402

[45] Date of Patent: Aug. 22, 1989

[54] BUILDING BOARD, PARTICULARLY GYPSUM PLASTERBOARD

[76] Inventor: Helmar Putz, A-4822 Bad Goisern 517, Austria

[21] Appl. No.: 806,698

[22] Filed: Dec. 9, 1985

[30] Foreign Application Priority Data

Jan. 24, 1985 [AT] Austria ..... A 175/85

[51] Int. Cl.[4] ..... E04B 2/00

[52] U.S. Cl. ..... 52/105

[58] Field of Search ..... 52/105; 33/1 B, 1 G, 33/494

[56] References Cited

U.S. PATENT DOCUMENTS

| | | | |
|---|---|---|---|
| Re. 22,481 | 5/1944 | Kaye | 52/314 |
| 304,245 | 8/1884 | Thomas | 33/1 B |
| 1,116,918 | 11/1914 | Putnam et al. | 33/494 X |
| 1,628,681 | 5/1927 | Newman | 52/314 X |
| 1,706,661 | 3/1929 | Greenbaum | 52/314 |
| 2,270,419 | 1/1942 | Debo | 52/105 |
| 2,375,427 | 5/1945 | Mannino | 33/1 B |
| 2,635,359 | 4/1953 | Broscious | 434/72 |
| 2,738,584 | 3/1956 | Parker | 31/169 R |
| 3,034,208 | 5/1962 | Kime | 33/36 X |
| 3,763,609 | 10/1973 | Probst | 52/105 |

FOREIGN PATENT DOCUMENTS

| | | | |
|---|---|---|---|
| 2005348 | 8/1971 | Fed. Rep. of Germany | 52/105 |
| 529509 | 6/1955 | Italy | 33/1 B |
| 617242 | 5/1980 | Switzerland | 52/105 |
| 10220 | 5/1896 | United Kingdom | 52/105 |

OTHER PUBLICATIONS

K & E Graph Sheets, Keuffel & Esser Co., 1949.

American Builder's Technical Section, Modular Planning, *American Builder,* Sep. 1944.

Forest Industries, Mar. 1984, p. 50.

*Primary Examiner*—David A. Scherbel

*Assistant Examiner*—Jerrold D. Johnson

*Attorney, Agent, or Firm*—Kurt Kelman

[57] ABSTRACT

In order to facilitate the placing of gypsum plasterboards, the boards are provided on their surface with a marking, which comprises length scales extending along regularly spaced apart lines which are parallel to the edges of the board. The marking may preferably be applied in the form of paints which fade under the action of light.

4 Claims, 1 Drawing Sheet

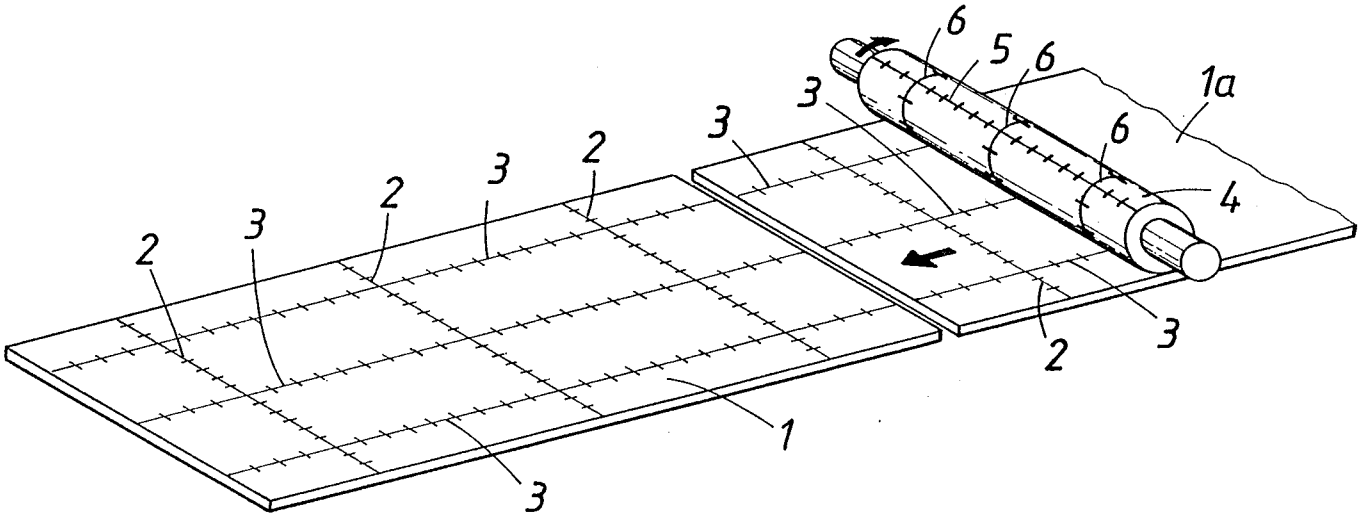
1a
6
5
6
6
4
3
3
3
2
2
3
2
3
2
1
3

BUILDING BOARD, PARTICULARLY GYPSUM PLASTERBOARD

BACKGROUND OF THE INVENTION

1. Field of the Invention

This invention relates to a building board, particularly to a gypsum plasterboard, which is provided with a surface marking.

2. Description of the Prior Art

Gypsum plasterboards or other prefabricated building boards can be used for numerous purposes and are indispensible in construction work. The boards are made in large quantities and are offered for sale in predetermined, standardized sizes. Before they are placed, they must be cut to the required size and must be marked to indicate fixing points for receiving nails, screws or other fasteners. The measuring and marking work required for that purpose is rather complicated and time-consuming and must be carried out with reasonable care. Because the boards are often placed by unskilled workers these requirements often result in long delays in the work and, owing to errors in the preparatory work, in a consumption of more boards than would actually be required. Whereas building boards marked at individual fixing points have already been provided, said fixing point marks will be useful only when entire boards are placed in a standard manner, whereas the fixing point marks of such known boards do not facilitate the cutting of such boards to size or the fastening of boards which have been cut to size or the fastening of non-standard boards.

SUMMARY OF THE INVENTION

For this reason it is an object of the invention to provide a building board which is of the kind described first hereinbefore and can always be placed efficiently in a simple, inexpensive operation regardless of the existing conditions.

This object is accomplished in accordance with the invention in that the marking comprises length scales extending along regularly spaced apart lines, which are parallel to the edges of the board. Transverse scales extending across the board may be supplemented by three longitudinal scales, which extend throughout the length of the board and consist of a center scale and two lateral scales, so that a wide-mesh grid is formed. That marking comprises length scales which are distributed over the surface of the board so that the boards can be cut to size virtually without a need for additional measuring tapes or rules and can be fixed at the desired points. The cutting to size and the finding of the fixing points can be effected skillfully and quickly without great care and the markings will be equally useful for a standardized or nonstandard placing of the boards. In order to ensure a clear arrangement, one transverse scale and three longitudinal scales per meter will be sufficient. Locations which are defined by standards may be emphasized in the scales. It will be obvious that there is no restriction regarding the marking, which can suitably be selected in consideration of the conditions as regards size and system of units. The lines may be applied to the boards during their manufacture with a low expenditure, for instance by means of a marking roller, which extends across the width of the board and is provided with suitable marking elements which extend along the roller and serve to provide the transverse scales and with marking elements which are peripherally spaced apart and serve to provide the longitudinal lines when said roll is caused to roll on the surface of the boards as they are made in the form of a continuous web. In such an operation the web is formed with regular transverse scales having a spacing that depends on the circumference of the roller and with continuous longitudinal scales, which are distributed across the width of the board and are formed by the peripheral marking elements of the roller.

In an embodiment within the scope of the invention, the marking is applied in the form of paints which fade under the action of light, e.g., in the form of light-colored water-soluble marking paints. When the boards are stacked in storage, they will cover each other and will thus prevent a premature fading of the markings so that the boards delivered to the building site will exhibit the markings as placing aids. When the boards have been placed so that the marking is superfluous, the paints fade under the action of light and become virtually invisible so that the marking will not produce undesired secondary effects, e.g., when the placed boards are subsequently painted after they have been placed.

BRIEF DESCRIPTION OF THE DRAWING

The drawing shows an embodiment of the invention diagrammatically in a perspective view.

DETAILED DESCRIPTION OF THE PREFERRED EMBODIMENT

Gypsum plasterboards 1 are made by cutting a continuous web 1*a* to length. The width of the boards equals the width of the web and the length of the boards is determined by the cutting of the boards from the web. In order to facilitate the placing of the gypsum plasterboards 1, which are made in large quantities, a marking is applied to the surface of the board. That marking consists of transverse and longitudinal lines 2 and 3, respectively, which are provided with length scales and constitute a wide-mesh grid. Three longitudinal scales 3 consist of a center scale and two lateral scales, and regularly spaced apart transverse scales 2 are distributed over the length of the board. With the aid of that marking the boards 1 can be cut to the required size virtually without a need for additional measuring means when the boards are to be placed and the required fixing points can be marked. Certain standardized distances between fixing points or certain standardized sizes may be indicated by special symbols in the length scales.

The markings are provided on the gypsum plasterboards 1 during their manufacture. This can be roller 4, which rolls on the web 1*a* and carries marking elements 5 and 6, which are respectively spaced apart in the axial and peripheral directions and serve to apply the transverse and longitudinal scales 2, 3. The marking element 5 extending in the axial direction of the roll 4 prints transverse scales 2 on the top surface of the board at regular intervals, which depend on the circumference of the roll. The three peripherally extending marking elements 6 print continuous longitudinal scales 3 on the board surface. As a result, the boards 1 which have been cut to length have already been provided with a wide-mesh grid and can be packaged and stored in the conventional manner.

If the marking roller 4 applies the transverse and longitudinal scales 2, 3 to the surface of the boards in the form of a paint which fades under the action of light, the marking will disappear when it is exposed to light so that an adverse effect on the surface appearance of the boards 1 which have been placed, e.g., when the boards are to be painted, need not be feared.

It will be understood that the embodiment shown and described can be modified within the scope of the invention. For instance, each scale may consist only of length graduations without a line connecting said graduations or the graduations of each scale may consist of grid lines connecting adjacent scales.

I claim:

1. A prefabricated rectangular building board for use in constructing a wall, the board having two parallel longitudinal edges, two parallel transverse edges extending perpendicularly to the longitudinal edges and a removable surface marking facilitating cutting, placing and fastening of the board to construct the wall, the surface marking consisting of a wide-mesh grid constituted by three longitudinal scales extending parallel to the longitudinal edges along lines regularly spaced apart in a transverse direction, the longitudinal scales including a center scale extending along a center line between the longitudinal edges and two scales extending on opposite sides of the center line adjacent respective ones of the longitudinal edges, and three transverse scales extending parallel to the transverse edges along lines regularly spaced apart in a longitudinal direction, the transverse scales including a center scale extending along a center line between the transverse edges and two scales extending on opposite sides of the center line adjacent respective ones of the transverse edges.

2. The prefabricated rectangular building board of claim 1, being a gypsum plasterboard.

3. The prefabricated rectangular building board of claim 1, wherein the surface marking consists of a water-soluble marking paint.

4. The prefabricated rectangular building board of claim 1, wherein the surface marking consists of a paint which fades under the action of light.

* * * * *